US006550647B1

(12) United States Patent
Künz

(10) Patent No.: US 6,550,647 B1
(45) Date of Patent: Apr. 22, 2003

(54) BLOWN MULTI-CHAMBERED PLASTIC BOTTLE AND CLOSURE THEREFOR

(75) Inventor: Hans Künz, Hard (AT)

(73) Assignee: ALPLA-Werke Alwin Lehner GmbH & Co., KG, Hard (AT)

( * ) Notice: Subject to any disclaimer, the term of this patent is extended or adjusted under 35 U.S.C. 154(b) by 0 days.

(21) Appl. No.: 09/762,533

(22) PCT Filed: Jul. 29, 1999

(86) PCT No.: PCT/CH99/00354

§ 371 (c)(1),
(2), (4) Date: Feb. 8, 2001

(87) PCT Pub. No.: WO00/09413

PCT Pub. Date: Feb. 24, 2000

(51) Int. Cl.[7] ..... B67D 5/56

(52) U.S. Cl. ..... 222/129; 222/94; 222/145.1; 220/530; 215/6

(58) Field of Search ..... 215/6; 220/530; 222/129, 94, 145.1

(56) References Cited

U.S. PATENT DOCUMENTS

| | | | | | |
|---|---|---|---|---|---|
| D214,549 | S | * | 7/1969 | Woodbridge | D9/18 |
| 3,729,553 | A | * | 4/1973 | Gold et al. | 424/44 |
| 4,238,049 | A | | 12/1980 | Lehmann et al. | |
| 4,314,651 | A | | 2/1982 | Gaiser et al. | |
| 4,849,213 | A | * | 7/1989 | Schaeffer | 424/53 |
| 4,976,350 | A | | 12/1990 | Fukumoto | |
| 5,154,917 | A | * | 10/1992 | Ibrahim et al. | 424/7.1 |
| 5,269,441 | A | * | 12/1993 | O'Meara | 222/94 |
| 5,441,702 | A | | 8/1995 | Lemieux et al. | |
| 5,660,299 | A | | 8/1997 | Harvey | |
| 5,928,681 | A | * | 7/1999 | Everette et al. | 425/525 |

FOREIGN PATENT DOCUMENTS

| | | |
|---|---|---|
| DE | 8618905.0 | 10/1986 |
| DE | 8620007.0 | 11/1986 |
| DE | 8901835.4 | 5/1989 |
| DE | 9105431.1 | 8/1991 |
| DE | 9200369.9 | 5/1992 |
| DE | 40 38 324 A1 | 6/1992 |
| DE | 9215964.8 | 6/1994 |
| DE | 9408948.5 | 9/1994 |
| DE | 297 01 969 U1 | 5/1997 |
| DE | 297 19 950 U1 | 2/1998 |
| DE | 297 00 314 U1 | 6/1998 |
| DE | 197 42 493 C1 | 2/1999 |
| EP | 0 628 484 A2 | 12/1994 |

* cited by examiner

*Primary Examiner*—Gene Mancene
*Assistant Examiner*—Melvin A. Cartagena
(74) *Attorney, Agent, or Firm*—Burns, Doane, Swecker & Mathis, LLP

(57) ABSTRACT

A multi-chamber bottle that can be made by a blowing process for separately holding different products, requiring only a single closure. The bottle may, for example, have two chambers with openings which are disposed inside the neck of the bottle. One of the opening is disposed coaxially with the neck. This allows a closure to be screwed or snapped onto the neck that is provided with a thread or a snap bead. In the process, the attachment penetrates the opening in a sealing manner. This creates two channels, which lead from the chambers to the outlet openings. The outlet openings can be closed with a cap.

17 Claims, 4 Drawing Sheets

BLOWN MULTI-CHAMBERED PLASTIC BOTTLE AND CLOSURE THEREFOR

BACKGROUND OF THE INVENTION

1. Field of the Invention

The present invention generally relates to containers and, more particularly, to a plastic multi-chamber bottle, made by a blowing process, especially for separately holding different products, as well as to a closure for such a multi-chamber bottle.

2. Background Information

Multi-chamber bottles are already on the market. They are used, for instance, as vessels for two-component adhesive. To that end, the chambers are completely separated from one another and each is provided with its own neck. A separate closure is required for each neck.

German Patent Disclosure DE-A-42 19 598, hereby incorporated by reference in its entirety, discloses a dual-chamber bottle that comprises two separate bottles, resting side by side on one another, each with its own bottle neck. The two bottles are held together by a common plastic closure and can be closed by it. It proves disadvantageous that this dual-chamber bottle comprises two parts and accordingly cannot be produced in one piece by blowing. U.S. Pat. No. 5,765,725, hereby incorporated by reference in its entirety, describes a cylindrical bottle that is divided by a dividing wall into two chambers of semicircular cross section. This reference says nothing about how such a bottle is to be produced. Production by blowing from a length of tubing is precluded, because a dividing wall has to be created.

In European Patent Application EP-A-0 875 460, which was not published before the priority date of the present application and is hereby incorporated by reference in its entirety, a plastic multi-chamber bottle made by the blowing process is described that has at least two separate chambers whose walls are joined together by a rib and which have an opening inside or under a common neck. For bottles with chambers completely separated from one another, a spout is described, which terminates the neck and has channels that lead from the openings of the chambers to a spout part. The spout part is secured to the bottle by a fastening part. To that end, the fastening part has detent protrusions that snap onto an annular protrusion of the neck. Closing the various pour openings of the multi-chamber bottle requires additional closure means.

SUMMARY OF THE INVENTION

It is the object of the present invention to create a plastic multi-chamber bottle that can be made by the blowing process for separately holding different products, which requires only a single closure. A closure of this kind is also to be created.

According to a first embodiment of the present invention, a multi-chamber bottle made of plastic and produced by a blowing process is provided, comprising at least two chambers separate from one another, whose walls are joined together by a rib, wherein each of the chambers, inside or below a common neck, has a respective opening; and a closure having at least two channels, wherein each channel leads from an opening of one chamber to one of at least two pour openings, and having at least one cap for closing at least one of the pour openings.

One advantageous version of the multi-chamber bottle provides that the opening of one of the chambers is embodied as circular and disposed coaxially to the neck; that the neck has a thread, and that the closure is provided with a thread corresponding to this thread. This has the advantage that the closure can be joined in a simple way to the multi-chamber bottle by a screw connection.

The opening of one of the chambers can be embodied in circular form and can be disposed coaxially to the neck. The opening is also advantageously calibrated. This makes it possible for one of the channels to be disposed coaxially to the neck and embodied as a tubular attachment, which when the closure is in place protrudes fittingly into the coaxial opening of the chamber. This assures a tight connection of the chamber to the pour opening.

It is also possible for one or more or all of the openings of the chambers to be disposed eccentrically to the neck. Furthermore, it is possible to provide a partition in the closure, the partition extending to the bottom of the neck and separating the channels from one another. A flange that rests sealingly on the neck is advantageously provided on the closure.

According to a second embodiment of the present invention, a closure for a multi-chamber bottle is provided, the bottle having at least two chambers separate from one another, whose walls are joined together by a rib, wherein each of the chambers has one opening inside or below a common neck, and having at least two channels in order to form passageways for the contents of the chambers to corresponding pour openings, the closure comprising at least one cap for closing one or more pour openings; and fastening means for mounting the closure on the multi-chamber bottle.

Advantageously, one of the channels is disposed coaxially to the fastening means. The fastening means are expediently formed by a thread. The channel disposed coaxially to the neck can be formed by a tubular attachment. The attachment then acts as a coupling to the corresponding chamber of the bottle. The tubular attachment is advantageously dimensioned such that with the closure in place, it engages the calibrated opening of the associated chamber in a sealing manner. Expediently, the closure has a partition, which extends from the spout through the bottle downward, so that when the closure in place the partition rests on the bottom of the neck.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1:
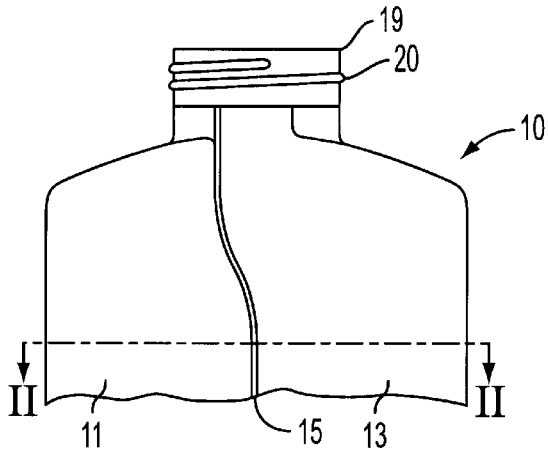
FIG. 1 is a side view of a dual-chamber bottle in accordance with an embodiment of the present invention, in which the opening of one of the chambers is disposed coaxially to the neck.
Figure 2:
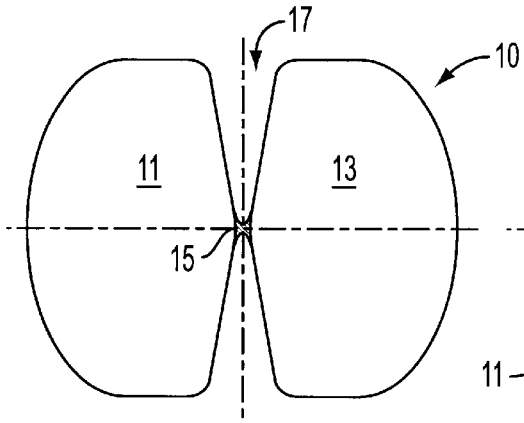
FIG. 2 is a section through view of the dual-chamber bottle of FIG. 1 taken along the line II—II.
Figure 3:
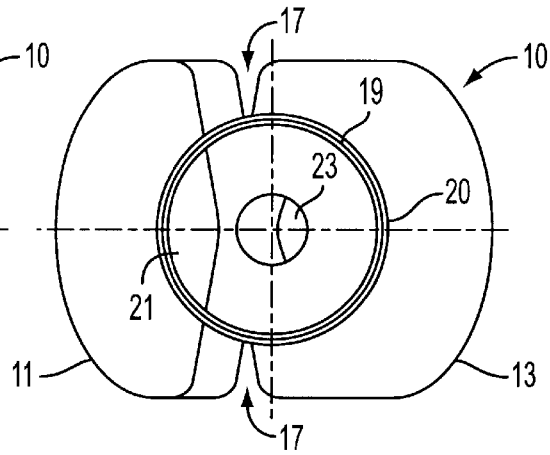
FIG. 3 is a top view of the bottle of FIG. 1.

The multi-chamber bottle 10 shown in FIGS. 1–4 can be made from plastic by a blowing process. It has two chambers 11, 13, whose walls are joined together by a rib 15. The chambers 11, 13 can be different in size and can also have different shapes. The rib 15 is formed upon closure of the blowing mold, in that the two halves of the blowing mold press together the tubing along a practically vertical line, so that the two opposed walls are joined to one another. This also creates the indentations 17 that are visible in FIG. 2. In the region of the neck 19, the chambers 11, 13 have openings 21, 23, which discharge inside or below this common neck 19. The opening 23 is advantageously calibrated. This makes a tight connection with a closure possible. A circular embodiment and coaxial disposition of the opening 23 relative to the neck 19 make it possible to use a closure provided with a thread. To that end, a male thread 20 can be provided on the neck 19. However, it would also be possible to provide a female thread on the neck 19. Still other fastening means are also possible, however, such as a snap device as in FIG. 5. The opening 23 is located in the bottom 25 of the neck 19. The other opening 21 is practically semicircular. However, it would also be possible to make this opening circular, oval, or of some other shape.

The wall thickness of the multi-chamber bottle 10 described is expediently so thin that the paste-like contents, for instance, of the bottle can be expelled by pressure. However, one skilled in the art will readily appreciate that given a suitable embodiment of the bottle, it can also be suitable for liquid or powdered contents.

Figure 4:
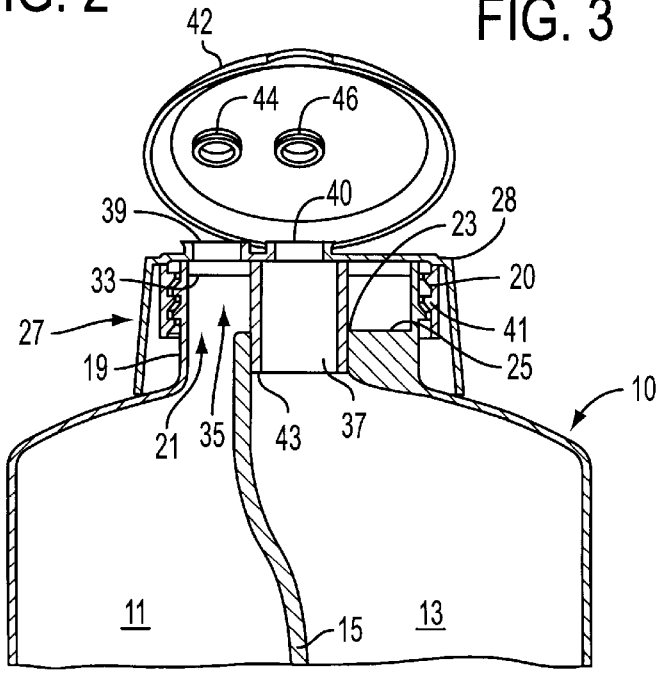
FIG. 4 is a section through view of the bottle of FIG. 1 with the closure in place.

As FIG. 4, a closure 27 is screwed onto the neck 19 of the bottle 10. The closure 27 is expediently made in one piece of plastic. The closure 27 has a flange 33, which protrudes into the neck 19 and seals it off. The closure 27 furthermore has channels 35, 37, which lead from the openings 21, 23 of the chambers 11, 13 to the pour openings 39, 40. For fastening the closure 27, there is a thread 41, which fits the thread 20 of the neck 19. A cap 42, pivotably connected to the closure body 28 with a film hinge, for instance, serves to close the pour openings 39, 40. To that end, pegs 44, 46 are provided on the cap 42, which when the cap 42 is closed penetrate the pour openings 39, 40. It is also possible to split the cap 42 in a sense, or in other words to provide a separate cap for each pour opening 39, 40, so that each chamber 11, 13 can be evacuated independently of another chamber. Even a closure embodied in this way can still be made in one piece.

The channel 37 disposed coaxially with the neck 19 is formed by a tubular attachment 43. This attachment 43 is dimensioned such that with the closure 27 in place, it sealingly engages the expediently calibrated opening 23.

Figure 5:
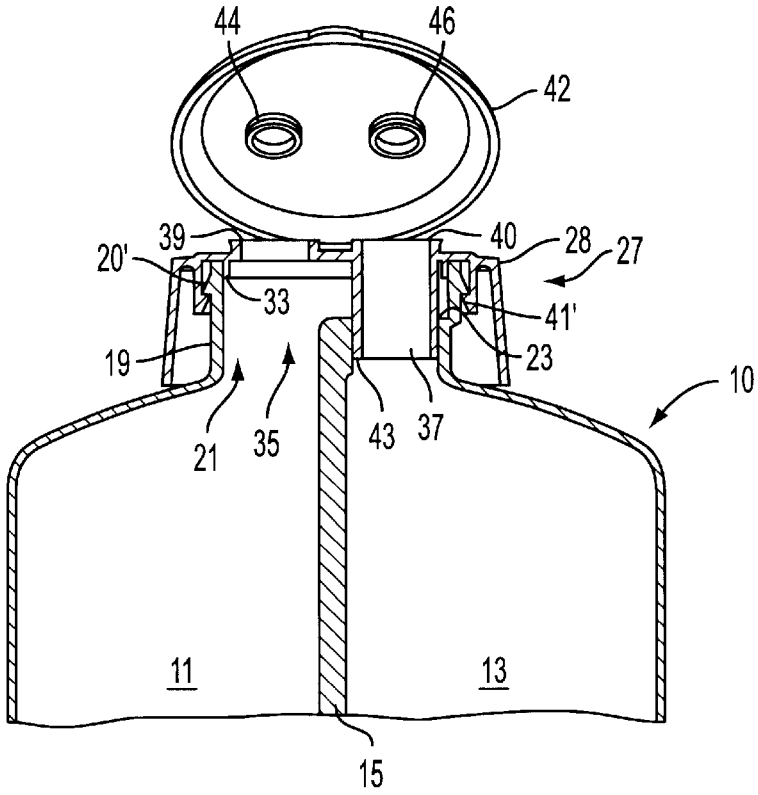
FIG. 5 illustrates a dual-chamber bottle with the closure in place in accordance with an embodiment of the present invention, in which the pour openings are disposed spaced apart from the bottle axis.
Figure 6:
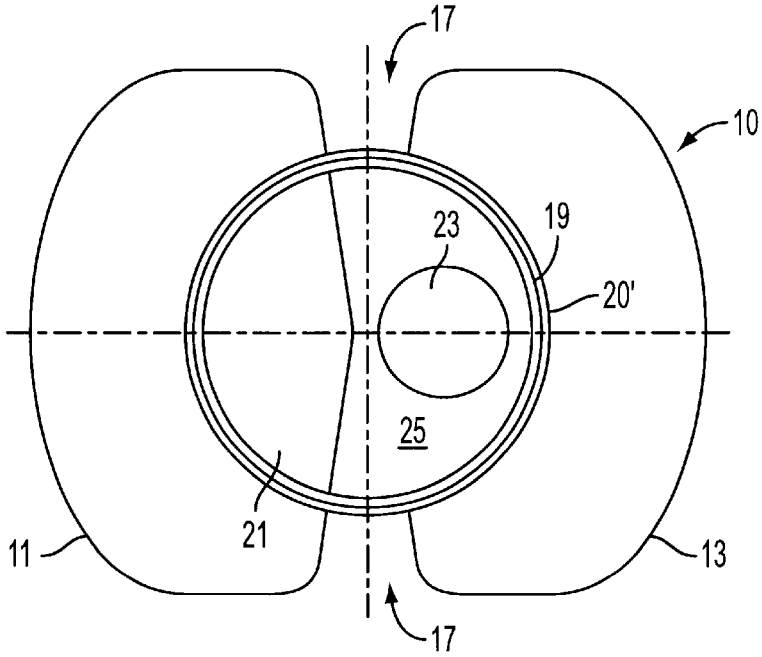
FIG. 6 is a top view of the bottle of FIG. 5 without the closure.

In the embodiment of FIGS. 5 and 6, neither of the openings 21, 23 is disposed concentrically with the neck 19. Accordingly, the closure 27 is not embodied so that it can be screwed on, either. The difference from the closure of FIG. 4 is thus essentially that instead of a thread, detent protrusions 41' are provided, which can snap onto an annular bead 20' of the neck 19. Otherwise, the closure 27 is embodied the same as that of FIG. 4, so that its description there can be referred to.

Figure 7:
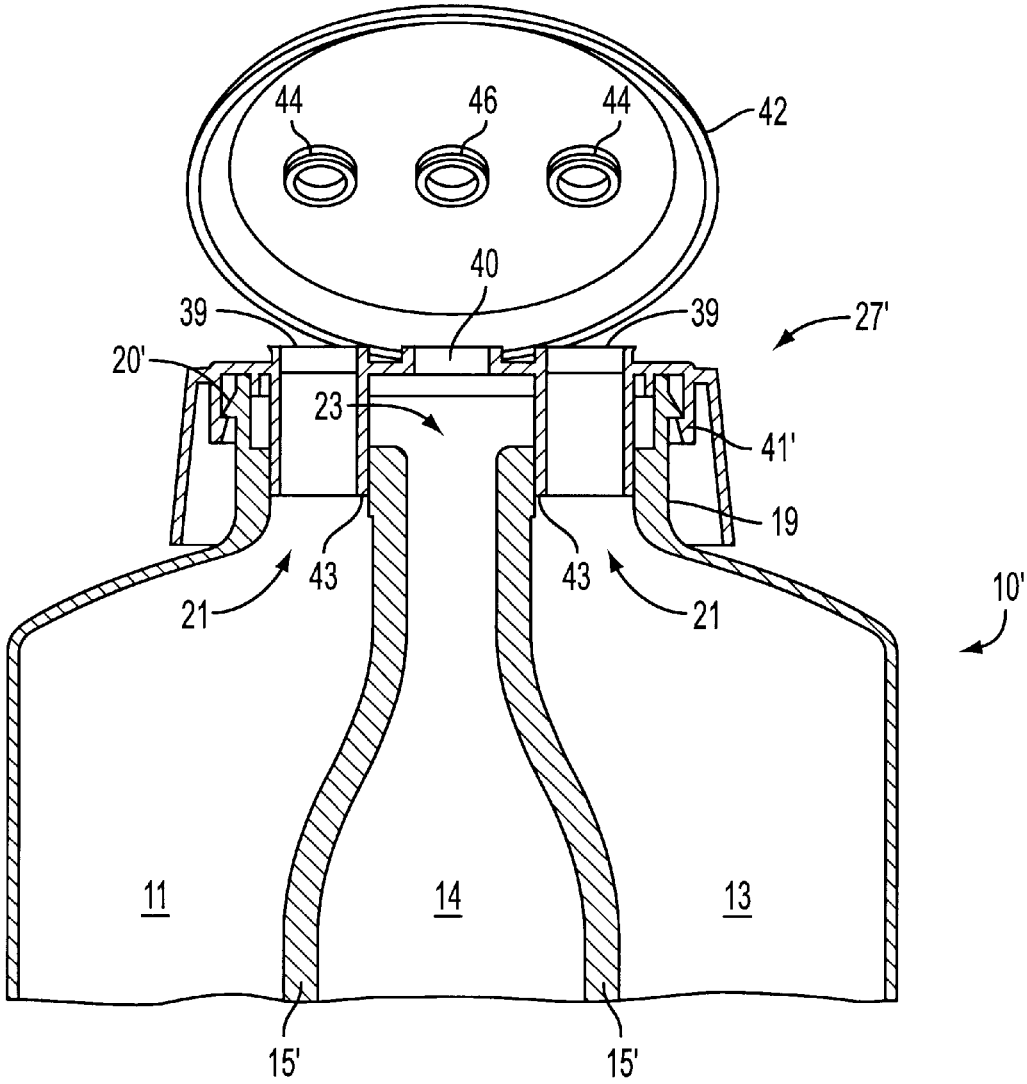
FIG. 7 illustrates a three-chamber bottle with the closure in place in accordance with an embodiment of the present invention.

The exemplary embodiment of FIG. 7 has a three-chamber bottle 10' with the chambers 11, 13 and 14. The three-chamber bottle is embodied analogously to the dual-chamber bottle of FIGS. 5 and 6, so that reference may be made to the description above. Instead of one rib, two ribs 15' are provided, which once again extend vertically over a substantial portion of the bottle. The closure 27' is embodied such that all three chambers 11, 13, 14 each communicate with one of pour openings 39, 40.

Figure 8:
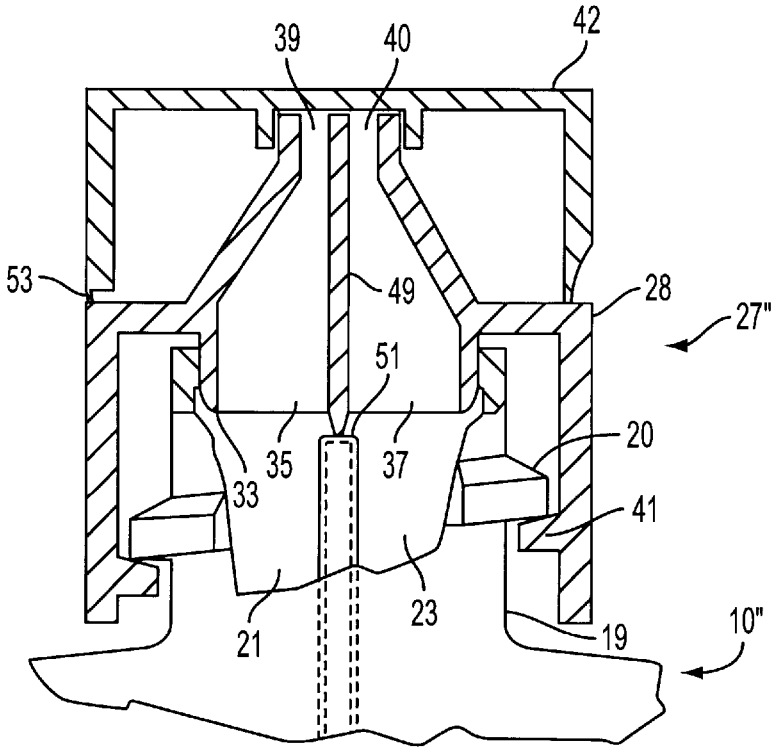
FIG. 8 illustrates a variant of a dual-chamber bottle with a mirror-symmetrical embodiment of the chambers in accordance with an embodiment of the present invention.
Figure 9:
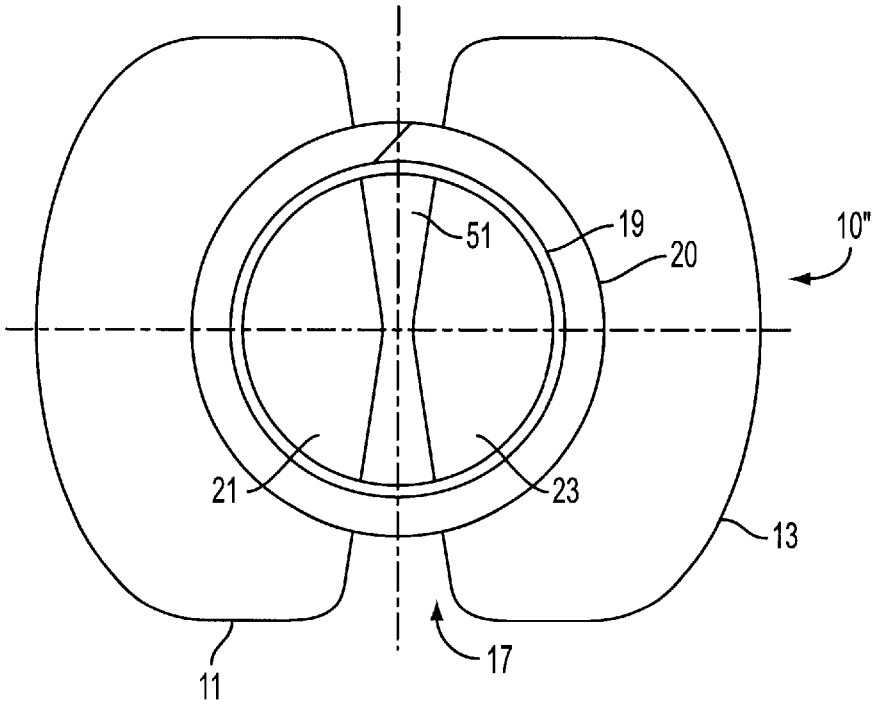
FIG. 9 is a top view of the bottle of FIG. 8 without the closure.

The multi-chamber bottle 10" of the third exemplary embodiment in FIGS. 8 and 9 is embodied practically mirror-symmetrically, at least in the region of the neck 19. The openings 21, 23 of the chambers 11, 13 are thus embodied practically identically. They are relatively large, thus facilitating filling of the bottle.

In accordance with the embodiment of the bottle, the closure 27" is also embodied largely symmetrically. The channels 35, 37 are separated from one another by a partition 49, which rests on the connection point 51 of the two chambers 11 and 13. This connection point 51 is in a sense a neck bottom 25, reduced to a narrow strip, as shown in FIG. 6. Although perfect sealing between the two chambers 11 and 13 is not achieved by the partition 49, still for many intended uses of the multi-chamber bottle this may suffice. For paste-like products, for instance, there is virtually no risk of problematic mixing anyway.

The closure 27" has a cap 42, which is joined to the closure body 28 with a film hinge 53. As already mentioned earlier, the closure can also have separate caps for the different pour openings, yet can still be made in one piece. As a fastening means for placement of the closure on the bottle, the closure can have a thread 41. A snap device can be used instead, however.

It will be appreciated by those skilled in the art that the present invention can be embodied in other specific forms without departing from the spirit or essential characteristics thereof. For instance, various characteristics of the embodiments shown can be combined; e.g., a snap closure can be provided instead of a thread. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A multi-chambered bottle made of plastic and produced by a blowing process, comprising:

at least two chambers separate from one another, whose walls are joined together by a rib, wherein each of the chambers, inside or below a common neck, has a respective opening; and a closure having at least two channels, wherein said closure is separate from said two chambers and is detachably connected to said common neck of said at least two chambers, wherein each channel leads from an opening of one chamber to one of at least two pour openings, and having at least one cap for closing at least one of the pour openings.

2. The multi-chamber bottle of claim 1, wherein the opening of one of the chambers is circular and disposed coaxially to the neck.

3. The multi-chamber bottle of claim 1, wherein at least one opening of the chambers is disposed eccentrically to the neck.

4. The multi-chamber bottle of claim 1, wherein the closure has a flange that rests sealingly on the neck.

5. The multi-chamber bottle of claim 1, wherein at least one of the channels, in the form of a tubular attachment, protrudes sealingly into the opening of one chamber.

6. The multi-chamber bottle of claim 1, wherein the closure has a partition, which extends to the bottom of the neck and separates the channels from one another.

7. The multi-chamber bottle of claim 1, wherein the neck has a thread, and the closure is provided with a thread corresponding to this thread.

8. The multi-chamber bottle of claim 1, wherein a snap bead is disposed on the neck, and the closure is provided with a snap device.

9. Closure for a multi-chambered bottle, the bottle having at least two chambers separate from one another, whose walls are joined together by a rib, wherein each of the chambers has one opening inside or below a common neck, wherein said closure is separate from said two chambers and is detachably connected to said common neck of said at least two chambers and having at least two channels in order to form passageways for the contents of the chambers to corresponding pour openings, the closure comprising:

at least one cap for closing one or more pour openings; and fastening means for mounting the closure on the multi-chambered bottle.

10. The closure of claim 9, wherein one of the channels is disposed coaxially to the fastening means.

11. The closure of claim 9, wherein at least one channel is disposed eccentrically to the neck.

12. The closure of claim 9, comprising a flange for sealingly contacting the neck.

13. The closure of claim 9, wherein at least one of the channels is in the form of a tubular attachment, which is dimensioned such that with the closure mounted in place, it sealingly engages the opening of the associated chamber.

14. The closure of claim 9, comprising at least one partition, which extends downward from the pour openings, so that when the closure is mounted in place it rests on the bottom of the neck of the bottle.

15. The closure of claim 9, wherein the fastening means are formed by a thread.

16. The closure of claim 9, wherein the fastening means are formed by a snap device.

17. The closure of claim 9, comprising a separately actuatable cap for each pour opening.

* * * * *

UNITED STATES PATENT AND TRADEMARK OFFICE

CERTIFICATE OF CORRECTION

PATENT NO. : 6,550,647 B1
DATED : April 22, 2003
INVENTOR(S) : Hans Künz

It is certified that error appears in the above-identified patent and that said Letters Patent is hereby corrected as shown below:

Title page,
Insert:
-- [30] Foreign Application Priority Data

August 10, 1998 (CH) 98 810 765.2 --

Signed and Sealed this

Twenty-sixth Day of August, 2003

JAMES E. ROGAN
*Director of the United States Patent and Trademark Office*